US005542586A

United States Patent [19]

Stockwell

[11] Patent Number: 5,542,586

[45] Date of Patent: Aug. 6, 1996

[54] DETERGENT DISPENSER

[75] Inventor: Colin Stockwell, Benoni, South Africa

[73] Assignee: Lever Brothers Company, Division of Conopco, Inc., New York, N.Y.

[21] Appl. No.: 323,318

[22] Filed: Oct. 14, 1994

[51] Int. Cl.[6] ..... B67D 5/06

[52] U.S. Cl. ..... 222/538; 222/570

[58] Field of Search ..... 222/109, 538, 222/568, 570, 571; 141/381; 215/214, 276; 220/254

[56] References Cited

U.S. PATENT DOCUMENTS

| | | | |
|---|---|---|---|
| 1,411,573 | 4/1922 | McGarrahan | 222/538 |
| 4,550,862 | 11/1985 | Barker et al. | 222/568 |
| 4,741,459 | 5/1988 | Silvenis et al. | 222/538 |
| 4,802,597 | 2/1989 | Dubach | 141/381 |
| 4,974,749 | 12/1990 | Mon | 222/571 |
| 5,181,630 | 1/1993 | McNally | 222/109 |

*Primary Examiner*—Andres Kashnikow
*Assistant Examiner*—Philippe Derakshani
*Attorney, Agent, or Firm*—Gerard J. McGowan, Jr.

[57] ABSTRACT

A detergent dispenser which includes i) a first part in the form of a closure which normally serves to seal a detergent container and ii) a second part in the form of a cap, having an aperture for dispensing detergent. The closure and the cap have complementary formations to enable the cap releasably to be joined to the closed top of the closure.

5 Claims, 2 Drawing Sheets

DETERGENT DISPENSER

This invention relates to a detergent dispenser and more particularly to a dispenser for liquid washing detergent.

When doing household washing in an automatic washing machine, it is often useful to dab washing detergent on to soiled parts of clothing such as cuffs and collars before the clothing is placed in the washing machine.

It is an object of the invention to provide a novel dispenser of the above kind.

A detergent dispenser according to the invention comprises a first part in the form of a closure which normally serves to seal a detergent container, the closure having a closed top, a dependent skirt and an open mouth, and a second part which is releasably engageable with the closure over its open mouth, the second part having an aperture for dispensing detergent.

In a preferred form the closure has an external thread for screwing the closure into the detergent container.

The second part is preferably in the form of a shallow cap with an internal thread engageable with the external thread of the closure.

The closure and the cap preferably have complementary formations to enable the cap releasably to be joined to the closed top of the closure.

The aperture in the cap is preferably formed in a raised funnel formed in the top of the cap.

An embodiment of the invention will now be described by way of example with reference to the accompanying drawings in which.

Figure 1:
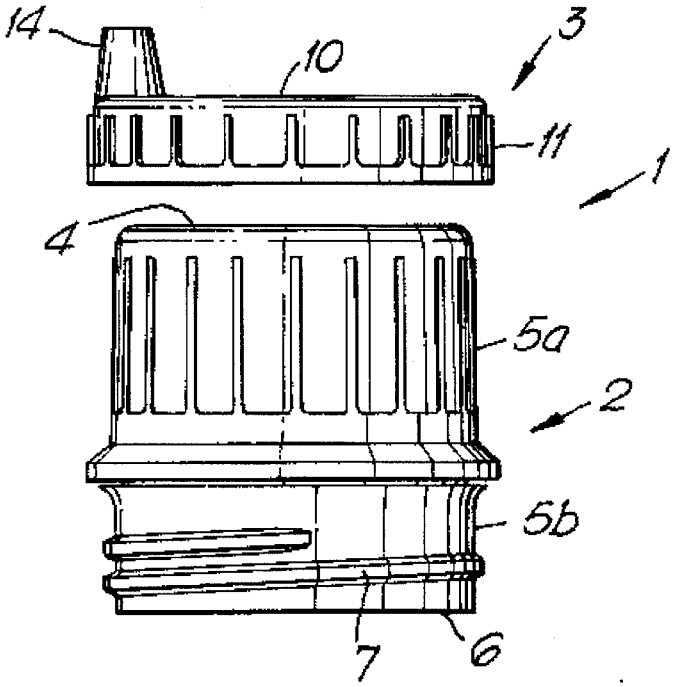
FIG. 1 is an elevation of two parts of a detergent dispenser made in accordance with the invention.

As shown in the drawings a dispenser 1 comprises a first part in the form of a closure 2 and a second part in the form of a cap 3.

The closure 2 comprises a top 4 having a dependent skirt made up of upper and lower sections 5*a*, 5*b*. The lower section 5*b* defines an open mouth 6 of The closure and has an external thread 7 which enables the closure to be screwed into and to seal a suitable container such as a liquid detergent bottle (not shown). The closure 2 therefore normally serves the purpose of stealing a detergent bottle.

Figure 6:
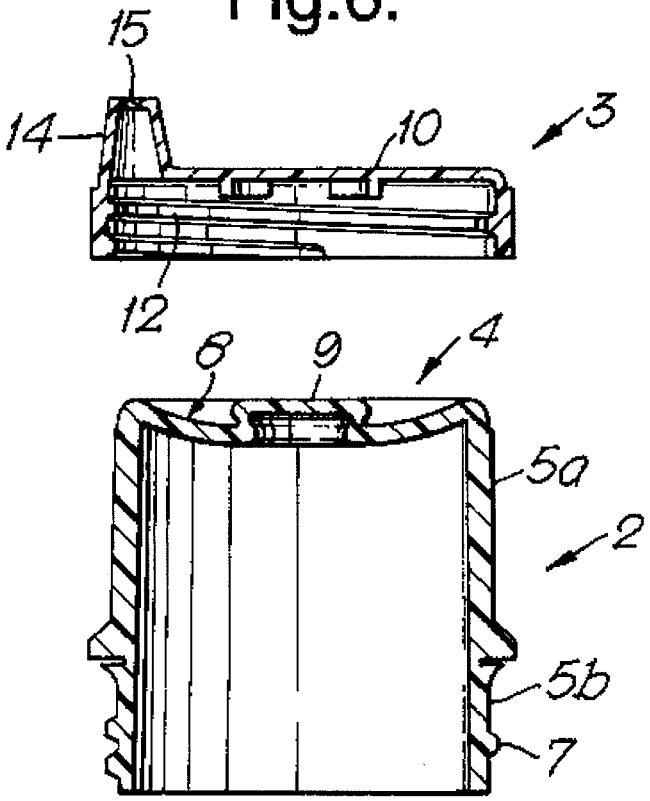
FIG. 6 is a cross-section of the parts of the dispenser shown in FIG. 1.

The top of the closure has a sunken peripheral channel 8 surrounding a centrally located pedestal 9 (see FIG. 6).

The cap 3 has a top 10 and a narrow dependant skirt 11. The skirt 11 has an internal thread 12 (FIG. 6) which is adapted to engage the external thread 7 on the closure 2. In its top 10 the cap 3 has a raised arcuate funnel 14 with an aperture 15 therein.

On the underside of the top of the cap 3 dependent arcuate flanges 16 are provided which are formed in the shape of a circle and which correspond with the pedestal 9 on the top of the closure 2.

Figure 2:
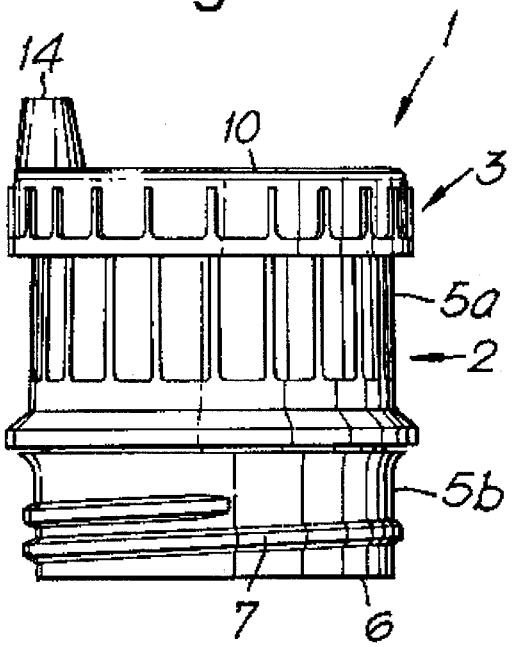
FIG. 2 is a similar view of the parts of the dispenser joined in an inoperative condition.

The flanges 16 are provided to snap over the peripheral edge of the pedestal 9 when the cap is located over the top of the closure 2. The cap can thus releasably and inoperatively be joined to the closure 2 (see FIG. 2).

Figure 3:
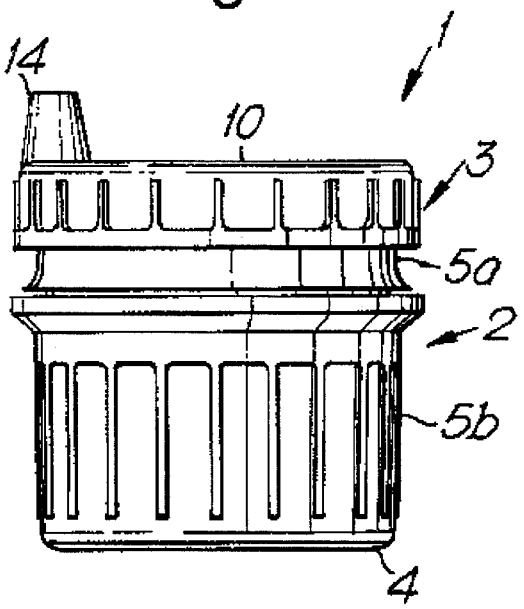
FIG. 3 is a similar view of the parts of the dispenser joined in an operative condition.
Figure 4:
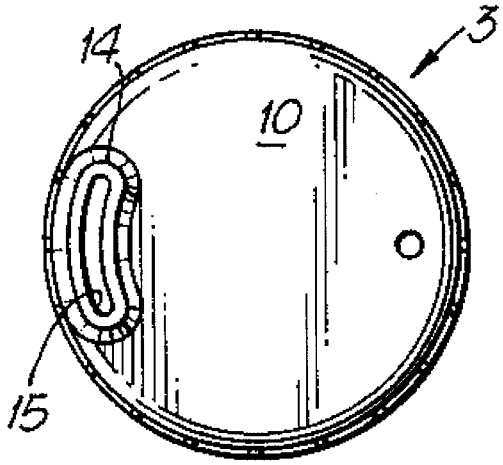
FIG. 4 is a plan view from above of the cap of the dispenser.
Figure 5:
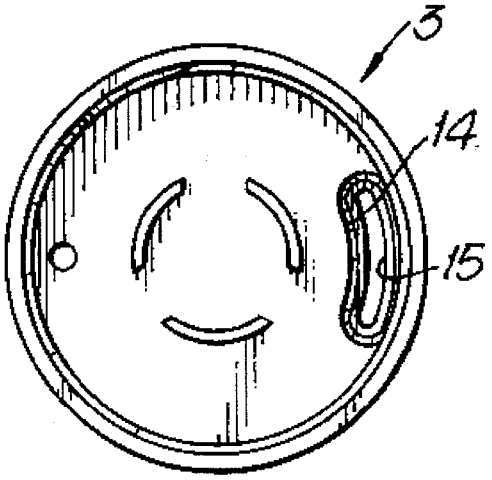
FIG. 5 is a plan view from below of the cap of the dispenser.

In use, the closure 2 may be removed from its bottle, inverted and filled with detergent from the bottle. The cap 3 may then be operatively joined to the closure by screwing the cap over mouth 7 of the closure (FIG. 3). Detergent may thereupon be dispensed through the aperture 15 in the cap 3 to soiled parts of clothing such as cuffs and collars.

Thus the invention provides a useful dispenser for use in clothes washing.

Many other embodiments of the invention may be made without departing from the scope of the invention described in the appended claims.

I claim:

1. A detergent dispenser comprising:

i) a first part in the form of a closure which has a closed top and which normally serves to seal a detergent container, and ii) a second part in the form of a cap having an aperture for dispensing detergent wherein the closure and the cap have complementary formations to enable the cap releasably to be joined to the closed top of the closure.

2. A detergent dispenser as claimed in claim 1 in which the closure has an external thread for screwing the closure into the detergent container.

3. A detergent dispenser as claimed in claim 2 in which the second part is in the form of a shallow cap with an internal thread engageable with the external thread of the closure.

4. A detergent dispenser as claimed in claim 3 in which the aperture in the cap is formed in a raised funnel formed in the top of the cap.

5. The dispenser according to claim 1, wherein said closure includes a dependent skirt and an open mouth and wherein said second part is releasably engagable with the closure over its open mouth.

* * * * *